US006891459B1

(12) United States Patent
Buswell

(10) Patent No.: US 6,891,459 B1
(45) Date of Patent: May 10, 2005

(54) INDUCTIVE DEVICES HAVING A WIRE CORE WITH WIRES OF DIFFERENT SHAPES AND METHODS OF MAKING THE SAME

(76) Inventor: Harrie R. Buswell, 132 Lorraine Ct., Berea, KY (US) 40403

( * ) Notice: Subject to any disclaimer, the term of this patent is extended or adjusted under 35 U.S.C. 154(b) by 46 days.

(21) Appl. No.: 10/470,008

(22) PCT Filed: Jan. 23, 2002

(86) PCT No.: PCT/US02/01632

§ 371 (c)(1),
(2), (4) Date: Jul. 23, 2003

(87) PCT Pub. No.: WO02/059916

PCT Pub. Date: Aug. 1, 2002

Related U.S. Application Data

(60) Provisional application No. 60/263,684, filed on Jan. 23, 2001.

(51) Int. Cl.[7] ..... H01F 27/24

(52) U.S. Cl. ..... 336/83; 336/232; 29/602.1

(58) Field of Search ..... 336/83, 232, 60, 336/223; 29/602.1, 606; 174/129 R, 128.2

(56) References Cited

U.S. PATENT DOCUMENTS

| | | | | |
|---|---|---|---|---|
| 414,266 A | | 11/1889 | Thomson | 336/83 |
| 499,852 A | | 6/1893 | Pfannkuche et al. | 336/175 |
| 1,597,901 A | | 8/1926 | Kent | 333/177 |
| 2,034,346 A | | 3/1936 | Lauterbur | 107/12 |
| 2,179,661 A | | 11/1939 | Jones | 171/119 |
| 3,304,599 A | | 2/1967 | Nordin | 29/155.57 |
| 3,350,670 A | | 10/1967 | Strauch | 336/90 |
| 3,720,897 A | | 3/1973 | Feather et al. | 336/60 |
| 4,035,751 A | | 7/1977 | Walthew | 336/60 |
| 4,359,598 A | * | 11/1982 | Dey et al. | 174/40 R |
| 5,133,121 A | * | 7/1992 | Birbeck et al. | 29/872 |
| 5,171,942 A | * | 12/1992 | Powers | 174/129 R |
| 6,239,681 B1 | | 5/2001 | Buswell | 336/83 |
| 6,268,786 B1 | | 7/2001 | Buswell | 336/83 |

* cited by examiner

*Primary Examiner*—Anh Mai
(74) *Attorney, Agent, or Firm*—Miles & Stockbridge P.C.

(57) ABSTRACT

An inductive device (10) having a magnetic core (16), which includes a portion of a plurality of wires (17), and at least one electric winding (18) extending around the magnetic core, wherein each of the plurality of wires substantially encircles the at least one electric winding, and wherein the plurality of wires include wires having different cross-sectional shapes to increase the density of the magnetic core.

22 Claims, 2 Drawing Sheets

INDUCTIVE DEVICES HAVING A WIRE CORE WITH WIRES OF DIFFERENT SHAPES AND METHODS OF MAKING THE SAME

CROSS REFERENCE TO RELATED APPLICATION

This application claims the benefit of provisional Application No. 60/263,684, filed on Jan. 23, 2001, which is incorporated herein by reference.

BACKGROUND OF THE INVENTION

1. Field of the Invention

The present invention relates to the field of inductive devices, and more particularly to wire core inductive devices such as transformers, chokes, coils, ballasts, and the like.

2. Description of Related Art

It is common for low frequency application transformers and other inductive devices to be made up of a magnetic core comprising a plurality of sheets of steel, the sheets being die cut and stacked to create a desired thickness of the core. For many years the thickness (thus number of necessary pieces) of the stampings has been determined by a strict set of constraints, e.g. magnitude of eddy currents versus number of necessary pieces. The individual sheets of selected thickness are generally oxide-coated, varnished or otherwise electrically insulated from one another in order to reduce/minimize eddy currents in the magnetic core.

The present inventor has developed wire core inductive devices such as transformers, chokes, coils, ballasts, and the like having a magnetic core including a portion of a plurality of wires rather than the conventional sheets of steel. These devices and related methods of manufacturing the devices are set forth in detail in U.S. Pat. Nos. 6,239,681 and 6,268,786, which are incorporated herein by reference. These devices and methods overcome deficiencies of conventional inductive devices. One particular aspect of the devices, according to the above patents, is the use of different diameter wires for the magnetic core. The wires are arranged to provide a more dense packing of the magnetic core in order to improve its magnetic characteristics. Despite the improved density and magnetic characteristics provided by wires of different diameters, resultant spaces between adjacent wires still limit the overall efficiency of the magnetic core.

SUMMARY OF THE INVENTION

The present invention provides an inductive device having a magnetic core including a portion of a plurality of wires, and at least one electric winding extending around a magnetic core, wherein each of the plurality of wires substantially encircles the at least one electric winding, and wherein the plurality of wires include wires of different cross-sectional shapes to increase the density of the magnetic core and thereby improve the efficiency of the magnetic core.

The present invention also provides a method for making an inductive device, comprising the steps of providing a magnetic core including a portion of a plurality of wires, the plurality of wires including wires of different diameters arranged to increase the density of the magnetic core, arranging at least one electric winding around the magnetic core, and configuring each of the plurality of wires so as to substantially encircle the at least one electric winding.

In accordance with a preferred embodiment of the present invention, an inductive device is provided having a magnetic core formed of a portion of a plurality of wires, including wires having different cross-sectional shapes, and electric windings extending around the magnetic core. The windings are in direct contact with the magnetic core. The plurality of wires forming the magnetic core are spread and formed to substantially encircle the electric windings with the ends of the wires substantially meeting to complete a magnetic circuit. A band or other connector means holds the ends of the wires in place. The plurality of wires arranged in this manner provides a shield that substantially contains electromagnetic fields emanating from the device and that reduces the intrusion of electromagnetic fields from external sources.

In accordance with a preferred embodiment of the present invention, the magnetic core includes a portion of a plurality of wires, which include wires of different cross-sectional shapes that are arranged to provide a dense packing of the magnetic core, improving its density and thus its magnetic characteristics. The different cross-sectional shapes of the wires include, but are not limited to, circular, square, hexagonal, octagonal, oval, rectangular and/or other suitable shapes. The wires of a given shape may include wires having different diameters or cross-dimensions to further improve the density of the core.

In accordance with a preferred embodiment of the present invention, the wires of at least one electric winding comprise a plurality of wires, including wires of different cross-sectional shapes that are arranged to provide a more dense packing of the winding. The different cross-sectional shapes include, but are not limited to, circular, square, hexagonal, octagonal, oval, rectangular and/or other suitable shapes. The winding may also include wires having different diameters or cross-dimensions to further improve the density of the winding(s).

A preferred embodiment of a method of making an inductive device according to this invention comprises providing a magnetic core including a portion of a plurality of wires of different cross-sectional shapes. At least one electric winding is placed around the magnetic core, and the plurality of wires are formed to substantially encircle the at least one electric winding so as to complete a magnetic circuit.

BRIEF DESCRIPTION OF THE DRAWINGS

The foregoing and other features and advantages of this invention will be more fully appreciated from the following detailed description of the preferred embodiments with reference to the accompanying drawings, wherein.

DETAILED DESCRIPTION OF THE PREFERRED EMBODIMENT

Figure 1:
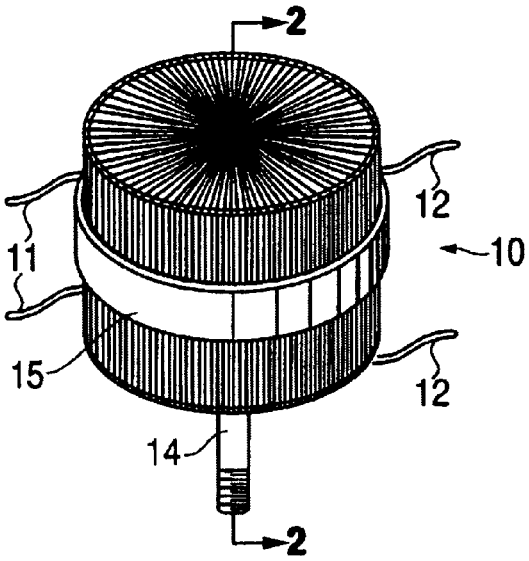
FIG. 1 is a perspective view of an inductive device according to a preferred embodiment of the present invention.

FIG. 1 shows a preferred embodiment of an inductive device 10 according to this invention. In this embodiment, the inductive device 10 is a transformer. It should be appreciated that the aspects of this invention are applicable to a variety of inductive devices, such as, but not limited to: transformers and coils (chokes, reactors, etc.) both of types that utilize core saturation (saturable transformers, magnetic amplifiers, saturable reactors, swinging chokes, etc.) and those that do not; as well as AC applications of solenoids; relays; contactors; and linear and rotary inductive devices.

The inductive device 10 includes leads 11 for connecting a power source (not shown) to the primary winding of the inductive device 10, and leads 12 for connecting the secondary winding to a load (not shown). Those skilled in the art will realize that designation of primary and secondary winding is somewhat arbitrary, and that one may use the leads 12 for connection to the primary winding, and the leads 11 for connection to a load. The designations of "primary" and "secondary" are therefore used herein as a convenience, and it should be understood that the windings are reversible.

Figure 2:
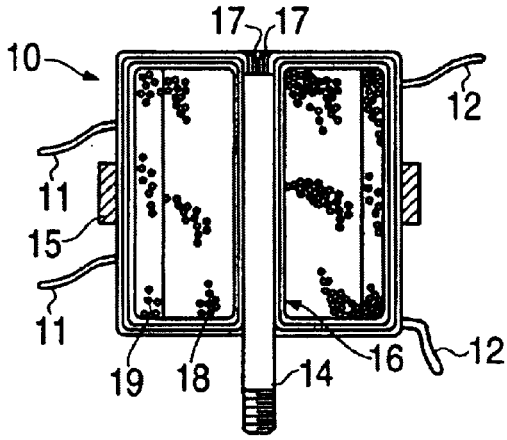
FIG. 2 is a cross-sectional view of the inductive device taken along the line 2—2 in FIG. 1.

FIG. 2 is a cross-sectional view of the inductive device 10 taken along the line 2—2 in FIG. 1. The inductive device 10 includes a magnetic core 16 formed of a portion of plurality of wires 17, rather than the conventional sheets of steel. The electric windings 18 and 19 extend around the magnetic core 16. The winding 18 is preferably in direct contact with the magnetic core 16, although this is not strictly necessary. The winding 19 extends around the winding 18.

The plurality of wires 17 utilized to form the magnetic core 16 extend outwardly therefrom and substantially encircle the electric windings 18 and 19, completing a magnetic circuit. The ends of the of the wires 17 meet, and are held together by a band 15 or the like. The leads 11 and 12 pass between the plurality of wires 17 to connect to the electric windings 18 and 19, respectively.

The inductive device further includes a post 14 disposed among the plurality of wires 17, as shown and described in aforementioned U.S. Pat. Nos. 6,239,681 and 6,268,786. The post 14 extends from the inductive device 10 at one end of the inductive device 10.

FIGS. 3A, 3B, 3C and 3D are partial cross-sectional views of magnetic cores of several exemplary embodiments of inductive devices according to this invention. These figures illustrate configurations of wires having shapes that can be utilized to form densely packed cores.

Figure 3A:
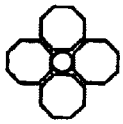
FIGS. 3A, 3B, 3C and 3D are partial cross-sectional views of exemplary embodiments of the magnetic core of an inductive device, according to this invention.

FIG. 3A illustrates the use of a circular wire with octagonal wires disposed around the circular wire. One of ordinary skill in the art can readily determine an appropriate ratio for the cross-sectional areas of the different wire shapes to optimize the magnetic core density in a particular application. For example, in FIG. 3A, the cross-sectional area of the octagonal wires may be about 8 times larger than the cross-sectional area of the circular wire so as to enhance the density of the magnetic core.

Figure 3B:
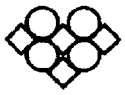

FIG. 3B illustrates the use of circular shaped wires and diamond shaped wires disposed among the circular wires. It is preferred that the diamond shaped wires have slightly rounded edges to prevent breaking or cracking of any insulation that the wires may have.

Figure 3C:
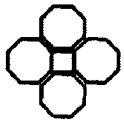

FIG. 3C illustrates the use of a square wire with octagonal wires disposed around the square wire. It is preferred that the square wire have slightly rounded edges to prevent breaking or cracking of any insulation that the wires may have.

Figure 3D:
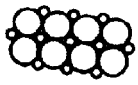

FIG. 3D illustrates the use of circular shaped wires and smaller oval shaped wires disposed among the circular wires.

The arrangements just described include wires of two different cross-sectional shapes. However, the plurality of wires that form the core may include wires with three or more different cross-sectional shapes. Further, it should be appreciated that the plurality of wires may include wires having different cross-sectional shapes such as, but not limited to, diamond shaped, circular, square, hexagonal, octagonal, oval, rectangular and/or other suitable shapes.

Figure 4:
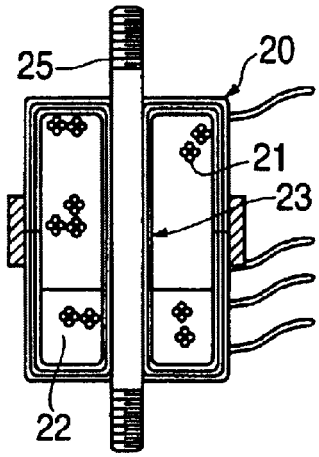
FIG. 4 is a cross-sectional view similar to FIG. 2, but showing an alternative embodiment of an inductive device according to this invention, wherein the electric windings include wires having different cross-sectional shapes.

FIG. 4 is a cross-sectional view similar to FIG. 2, but shows an inductive device 20 according to an alternative embodiment of this invention. The inductive device 20 is generally similar to the inductive device 10, except the electrical windings 21 and 22 are axially positioned beside one another around the magnetic core 23, instead of concentrically with each other as in the inductive device 10. The windings 21 and 22 are preferably in direct contact with the magnetic core 23, although this is not strictly necessary.

Further, a mounting post 25 extends from the plurality of wires at both ends of the inductive device 20, rather than at only one end.

In this embodiment, the wires used to form the electric windings 21 and 22 have hexagon and circular shaped cross-sections and are arranged to provide a more dense packing of the windings in order to improve the overall efficiency of the transformer 20. It should be appreciated the windings 21 and 22 do not have to have wires of the same combination of cross-sectional shapes. Additionally, it should be appreciated that the wires of the windings may have other cross-sectional shapes such as, but not limited to, circular, square, hexagonal, octagonal, oval, rectangular and/or other suitable shapes.

Figure 5:
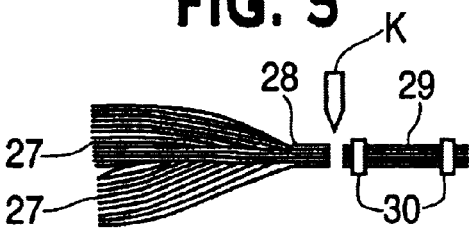
FIG. 5 illustrates a technique for providing a magnetic core according to a preferred embodiment of a method of the present invention.

The use of a plurality of wires to form a magnetic core yields an efficient method for making an inductive device as set forth in the aforementioned incorporated patents. In accordance with a preferred embodiment of this invention, FIG. 5 shows the step of providing a magnetic core 29, which includes gathering a plurality wires 27 that include wires of different cross-sectional shapes. The wires 27 are pulled from a creel (not shown) to form a bundle 28. The bundle is severed at a predetermined length with a knife K or the like. The resulting magnetic core 29 is held together by bands 30 or the like. As noted above, the use of different shaped wires allows for a more dense packing of the magnetic core 29, thereby improving its magnetic characteristics.

Figure 6:
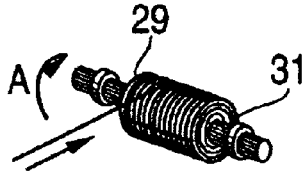
FIG. 6 illustrates the disposition of an electric winding around the magnetic core according to a preferred embodiment of a method of the present invention.

In accordance with the preferred method, at least one electric winding 31 is next placed on the magnetic core 29. The electric winding 31 is wound directly on the magnetic core 29, as indicated by arrow A in FIG. 6. Advantageously, this direct placement of the electric winding 31 on the magnetic core 29 provides a more efficient, and thus more economical method of manufacturing by eliminating steps in the prior art manufacturing methods.

Another advantage of winding the electric winding 31 directly on the magnetic core 29, is that the winding 31 assists in binding the wires 27 tightly together, thereby offering several mechanical and electrical advantages. These advantages include tighter magneto-electric coupling and reduced vibrational noise from the core.

According to an alternative embodiment, the at least one electric winding 31 is formed by winding a coil of wire on a spindle, not shown. The winding 31 is removed from the spindle and then placed over the magnetic core 29.

Figure 7:
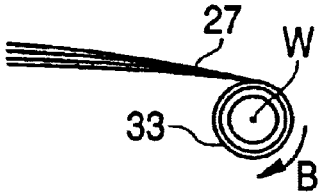
FIGS. 7 and 8 illustrate an alternative technique of providing a magnetic core according to the invention.
Figure 8:
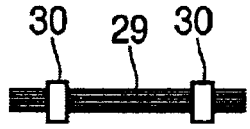

FIG. 7 illustrates an alternative technique for forming the magnetic core 29 of an inductive device in accordance with the present invention. In this technique, the magnetic core 29 is formed by feeding the wires 27, which include wires of different cross-sectional shapes, directly to a winder W which winds the wires 27, as shown by arrow B. The wound wire 33 is removed from the winder W, severed at a predetermined length, and straightened as shown in FIG. 8. By appropriately deforming the wound wire 33 before severing, the ends will be substantially square. As in the embodiment shown in FIG. 5, bands 30 or the like hold the plurality of wires together thus forming the magnetic core 29.

Figure 9:
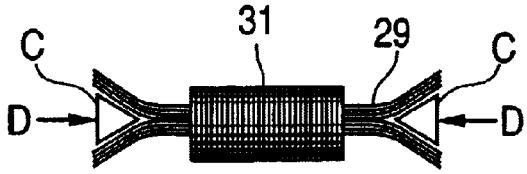
FIG. 9 is a view for explaining a technique of forming the plurality of wires to substantially encircle the electric winding in a preferred embodiment of this invention.

With the electric winding 31 in place on the magnetic core 29, the next step in the preferred embodiment is to configure the plurality of wires extending from the magnetic core 29 around the electric winding 31 to substantially encircle the winding 31 and form a complete magnetic circuit. FIG. 9 illustrates one manner of configuring the plurality of wires, in particular by moving a pair of cones C to spread the wires generally radially, as shown by arrows D. Conventional means may then be used to finish forming the wires around the electric winding 31 such that the wires substantially encircle the winding similar to the plurality of wires shown in FIG. 1.

Those skilled in the art will recognize that the magnetic core of an inductive device preferably forms a complete magnetic circuit. In a preferred embodiment, plurality of wires are formed around the electric winding such that the ends of the wires substantially meet. In accordance with the inventive method, the wires are preferably prepared by having their ends cleaned to provide for substantial abutment of the opposing ends. The ends of the wires are held together by a band or other means of connection. Alternatively, the band may be used in conjunction with or be replaced by a fine iron or steel wire (not shown) wrapped transversely around the device.

In addition to providing the desired complete magnetic circuit, the plurality of wires that form the magnetic core also form a shield. The device made in accordance with the method of the present invention may therefore be used in electrically noisy environments without adversely affecting or being adversely affected by surrounding components.

It will therefore be understood that the present invention provides a highly efficient method for making an inductive device and a highly efficient inductive device utilizing wires of different shapes to form a wire core. It should be noted that the wires that form the core, may be made of substantially the same silicon steel and other materials that are used for conventional cores. The wires of the present invention may be coated to be electrically insulated from one another to reduce eddy currents.

It should be appreciated that the shape of the inductive device according to this invention is not limited to the generally cylindrical shape of the illustrative embodiments. An inductive device according to this invention may be of any shape suitable for a specific application.

The foregoing descriptions of preferred embodiments of the invention have been presented for purposes of illustration. The descriptions and figures are not intended to be exhaustive or to limit the invention to the precise forms disclosed. Obvious modifications, variations and combinations are possible in light of the above teachings. The preferred embodiments were chosen and described to provide an illustration of the principles of the invention and its practical application to thereby enable one of ordinary skill in the art to utilize the invention in various embodiments and with various modifications as are needed for the particular use contemplated. Various changes may be made without departing from the spirit and scope of this invention.

What is claimed is:

1. An inductive device comprising:

a magnetic core including a portion of a plurality of wires; and at least one electric winding extending around said magnetic core, wherein each of said plurality of wires substantially encircles said at least one electric winding, and wherein said plurality of wires include wires having different cross-sectional shapes.

2. An inductive device as recited in claim 1, wherein the said plurality of wires are arranged to increase the density of said magnetic core.

3. An inductive device as recited in claim 1, wherein said cross-sectional shapes include at least one of a rectangle, a circle, a square, a hexagon, an octagon, and an oval.

4. An inductive device as recited in claim 1, wherein said at least one electrical winding includes wires having different cross-sectional shapes.

5. An inductive device as recited in claim 4, wherein said cross-sectional shapes of said wires of said electrical winding include at least one of a rectangle, a circle, a square, a hexagon, an octagon, and an oval.

6. An inductive device as recited in claim 1, wherein said plurality of wires substantially envelops said electric winding to provide shielding from electromagnetic fields.

7. An inductive device as recited in claim 1, wherein each of said plurality of wires includes a first end and a second end that substantially abut one another.

8. An inductive device as recited in claim 7, wherein said first and second ends of each wire meet.

9. An inductive device as recited in claim 7, wherein said first and second ends of each wire are secured in place.

10. An inductive device as recited in claim 9, wherein said first and second ends of said plurality of wires are secured by a band.

11. An inductive device as recited in claim 1, further comprising a mounting post disposed among said plurality of wires and extending from said plurality of wires.

12. An inductive device as recited in claim 11, wherein the mounting post extends from said plurality of wires only at one end of the inductive device.

13. An inductive device as recited in claim 1, further comprising a second electric winding extending around said magnetic core.

14. An inductive device as recited in claim 13, wherein said second electric winding is axially displaced from said one electric winding.

15. An inductive device as recited in claim 13, wherein said second electric winding is arranged concentrically with said one electric winding.

16. An inductive device as recited in claim 1, wherein said electric winding is in direct contact with said magnetic core.

17. An inductive device as recited in claim 1, wherein said plurality of wires are electrically insulated from one another.

18. A method for making an inductive device, comprising:

providing a magnetic core including a portion of a plurality of wires, the plurality of wires including wires having different cross-sectional shapes;

arranging at least one electric winding around the magnetic core; and configuring each of the plurality of wires so as to substantially encircle the at least one electric winding.

19. A method as recited in claim 18, further comprising arranging the plurality of wires to increase the density of the magnetic core.

20. A method as recited in claim 18, wherein said configuring includes substantially abutting first and second ends of each of the plurality of wires.

21. A method as recited in claim 18, wherein said configuring includes securing first and second ends of each of the plurality of wires in place.

22. A method as recited in claim 21, wherein said securing includes wrapping a band around the plurality of wires.

* * * * *